US007192095B2

(12) United States Patent
Sansone et al.

(10) Patent No.: US 7,192,095 B2
(45) Date of Patent: Mar. 20, 2007

(54) SUPPORT BASE FOR TOOLHOLDER OF A MILLING DRUM

(75) Inventors: Dario Sansone, Bologna (IT); Roberto Rubini, Bologna (IT)

(73) Assignee: Caterpillar Paving Products Inc, Minneapolis, MN (US)

( * ) Notice: Subject to any disclaimer, the term of this patent is extended or adjusted under 35 U.S.C. 154(b) by 0 days.

(21) Appl. No.: 10/476,895

(22) PCT Filed: May 8, 2002

(86) PCT No.: PCT/EP02/05104

§ 371 (c)(1),
(2), (4) Date: Nov. 5, 2003

(87) PCT Pub. No.: WO02/090717

PCT Pub. Date: Nov. 14, 2002

(65) Prior Publication Data

US 2004/0145232 A1 Jul. 29, 2004

(30) Foreign Application Priority Data

May 8, 2001 (IT) ..... VI2001A0100

(51) Int. Cl.
*E21C 35/18* (2006.01)

(52) U.S. Cl. ..... 299/106; 299/102

(58) Field of Classification Search ..... 299/102–103, 299/106, 108, 79.1, 87.1, 110, 112 R; 37/465, 37/455, 452; 175/432; 144/24.12, 334
See application file for complete search history.

(56) References Cited

U.S. PATENT DOCUMENTS 3,814,482 A * 6/1974 Bower et al. ..... 299/112 R
4,057,294 A * 11/1977 Krekeler ..... 299/102
4,180,292 A * 12/1979 Persson ..... 299/108
4,275,929 A * 6/1981 Krekeler ..... 299/102
4,349,232 A 9/1982 Braun et al.
4,621,871 A * 11/1986 Salani ..... 299/107
4,697,850 A * 10/1987 Tuneblom ..... 299/87.1
4,915,455 A * 4/1990 O'Neill et al. ..... 299/102
5,005,622 A * 4/1991 Beach et al. ..... 144/241

(Continued)

FOREIGN PATENT DOCUMENTS

DE 19908656 8/2000

(Continued)

*Primary Examiner*—Sunil Singh
(74) *Attorney, Agent, or Firm*—Finnegan, Henderson, Farabow, Garrett & Dunner

(57) ABSTRACT

A support base (1) which is to be mounted to the surface (2) of a milling drum (3) defining a direction of rotation (31) includes a recess (4) adapted to receive removably a shank portion (14; 21) of a body (5; 7) to be fixedly mounted to said support base (1). The recess (4) has a first side surface (101) facing into said direction of rotation (31) which is adapted to contact said shank portion (14; 21). The support base (1) further includes a reaction surface (111) adjacent to said first side surface (101) and also facing in said direction of rotation (31), wherein the reaction surface (111) is disposed at an angle of more than 180° with respect to said first side surface (101) and is adapted to bear against a support surface (151) of said body (5; 7).

19 Claims, 7 Drawing Sheets

U.S. PATENT DOCUMENTS

| | | | | |
|---|---|---|---|---|
| 5,011,229 | A | 4/1991 | O'Neill et al. | |
| 5,052,757 | A * | 10/1991 | Latham | 299/87.1 |
| 5,235,961 | A * | 8/1993 | McShannon | 125/43 |
| 2002/0093240 | A1 * | 7/2002 | Ritchey | 299/102 |
| 2004/0051370 | A1 * | 3/2004 | Montgomery | 299/106 |

FOREIGN PATENT DOCUMENTS

| | | | |
|---|---|---|---|
| EP | 0962627 | | 12/1999 |
| EP | 1033216 | * | 9/2000 |
| EP | 1043478 | | 10/2000 |
| GB | 2299354 | | 10/1996 |

* cited by examiner

SUPPORT BASE FOR TOOLHOLDER OF A MILLING DRUM

TECHNICAL FIELD

The present invention generally relates to a support base for a toolholder of a milling drum, and in particular to a tool arrangement on milling drums of scarifiers.

BACKGROUND ART

Scarifiers are working machines used for working and removing soils, in particular for making roads. In their standard constructional form these machines are provided with a milling drum having a plurality of active elements, e.g. cutting or milling elements, that—during rotation of the milling drum—come into contact with the surface to be removed and crush it.

In some prior art scarifiers, each active element is a tool arrangement consisting of a support base fixed to the tubular body of the milling drum, wherein the support base accomodates a respective toolholder in which a milling tool is removably inserted, for example, by pressing it into the toolholder.

The active elements are arranged on the milling drum corresponding to one or more right hand and left hand spirals starting from both ends of the milling drum and meeting at a central location on the milling drum. The required pitch of the spirals defined by the active elements varies according to the kind of soil to be worked on. Specifically, small pitches are adapted to work on hard asphalt and to carry out soil forming while large pitches are particularly adapted to carry out digging on concrete or soft mix.

For optimizing the working process, it is desired to have for each scarifier a couple of drums available, whereby these drums are provided with different pitches of the tools supported thereon so as to adapt the scarifier to the kind of soil to be worked on. In order to avoid the necessity of changing milling drums, it is known to provide a single milling drum with double threaded spirals having a small pitch, and thus adapted to work on hard asphalt or to carry out forming. Such a milling drum may be used also to carry out diggings on concrete or soft mix by removing the toolholders with the relevant tools arranged in the support bases along one of the adjacent spirals. Then, the same milling drum has the active elements arranged on a single spiral having a pitch which is about doubled to the previous one, so that it can efficiently be used for digging concrete or soft mix as well.

There are various support bases known in the art, which generally have to be of a solid construction to provide the required stability during operation of the milling drum. This constructions may be so volumnous that an empty support base interferes with a tool remaining on the milling drum. Also, in order to fixedly mount the toolholders to the respective support bases reliable connection means are required which often render the assembly and disassembly of the toolholders labour intensive.

SUMMARY OF THE INVENTION

In accordance with the present invention an easy and quick replacement of tools on a milling drum is facilitated by constructing the required support base and the support portion associated with respective tools more compact without compromising stability. Further, the present invention also provides for the protection of empty support bases for toolholders against damage resulting from contact with the soil to be removed by applying a protection cover adapted to be inserted and fastened to the respective support bases and also by allowing a greater distance between the empty support bases and the soil to be worked on.

According to one aspect of the invention this is achieved by providing a support base adapted to be mounted to the surface of a milling drum. The support base includes a recess adapted to receive removably a shank portion of a body, either a toolholder or a protection cover, to be fixedly mounted to said support base. The recess has a first side surface facing into the direction of rotation of the milling drum and being adapted to contact the shank portion. The support base further comprises a reaction surface adjacent to the first side surface and also facing in the direction of rotation, wherein the reaction surface is disposed at an angle of more than 180° with respect to said first side surface. The reaction surface is adapted to bear against a support surface of the body to be inserted into the support base and advantageously takes up forces applied to the body so as a lower constructional height of the support base is achievable.

According to a further aspect of the invention, a body adapted to be fixed to a support base mounted to the surface of a milling drum is provided. The body includes a shank portion adapted to be received in a recess of the support base. The shank portion includes a first side surface adapted to bear against a first side surface of the recess. The body further includes a second portion above and adjoining said shank portion and forming a first support surface adjacent to the first side surface and being inclined thereto. The support surface on the second portion and the first side surface on the shank portion form an obtuse angle. The first support surface is adapted to firmly bear against a reaction surface of the support base facing in a direction of rotation of the milling drum.

In another aspect of the invention, a support base is provided which is adapted to be mounted to the surface of a milling drum. The support base includes a recess for receiving removably a shank portion of a body to be fixedly mounted to said support base. The recess is at least partly formed by a wall including a slot open at one end for insertion of a fastening means into said slot for fixing said body to said support base. The slot and thus the support base can be provided with a minimum height just to receive the fastening means and preferably a stabilizing tongue portion projecting from the shank portion of the body.

In still another aspect of the invention, a body adapted to be fixed to a support base mounted to the surface of a milling drum is provided, wherein the body includes a shank portion adapted to be received in a generally C-shaped recess of the support base. The body further includes a tongue portion connected to the shank portion and extending away therefrom. The tongue portion is adapted to be slidingly received in an opening formed in a rear wall of said recess.

BRIEF DESCRIPTION OF THE DRAWINGS

The foregoing and other objects and advantages of the present invention will be better understood upon reading the following detailed description of a preferred embodiment of the invention when read in the light of the accompanying drawings in which.

DETAILED DESCRIPTION

With reference to FIGS. 1 to 10, a support base 1 in accordance with a preferred embodiment of the invention is mounted to the surface 2 of a tubular body of a milling drum 3. The milling drum 3 is part of a road work machine, in particular of a scarifier (not shown) to remove road surfaces. In operation, the milling drum 3 is rotated in a working or milling direction as indicated by an arrow 31 in FIGS. 1 to 3.

Figure 1:
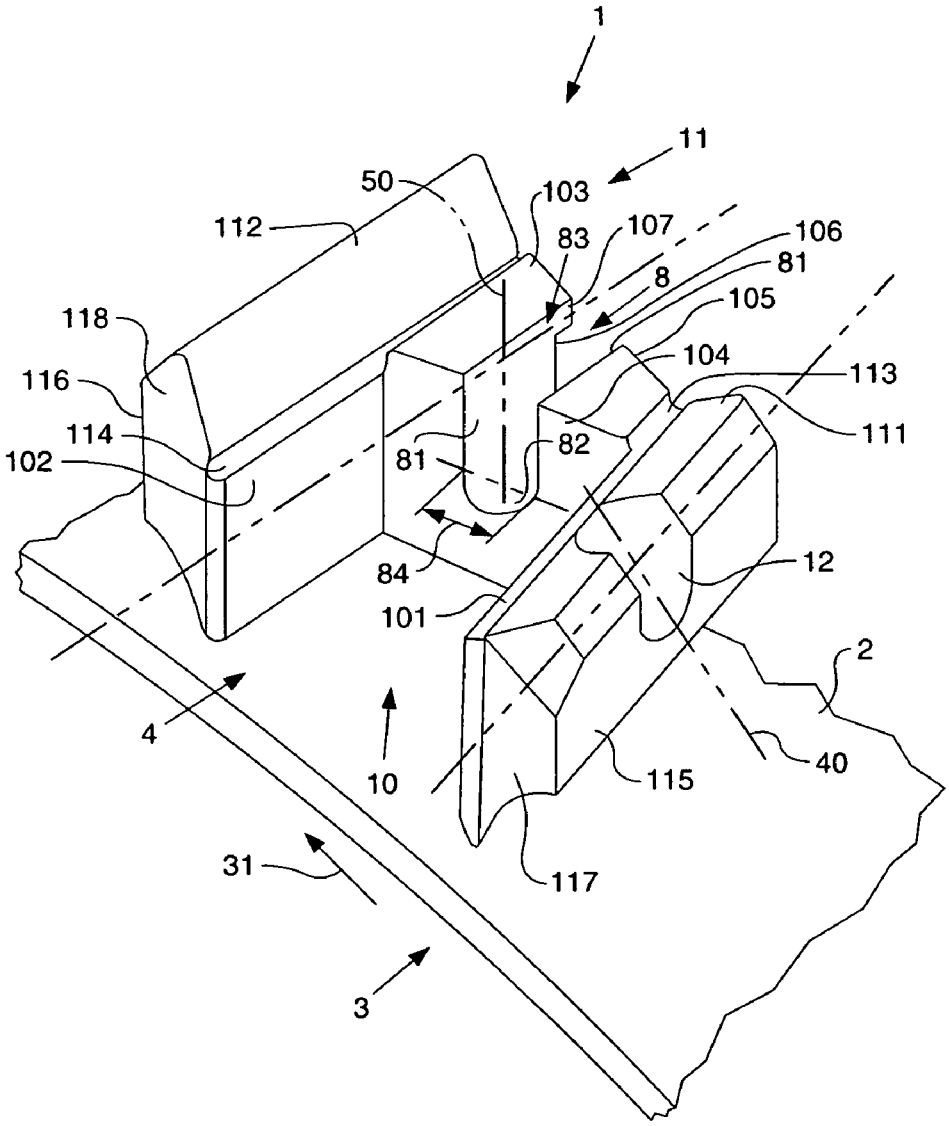
FIG. 1 is an isometric view of a preferred embodiment of the support base.
Figure 2:
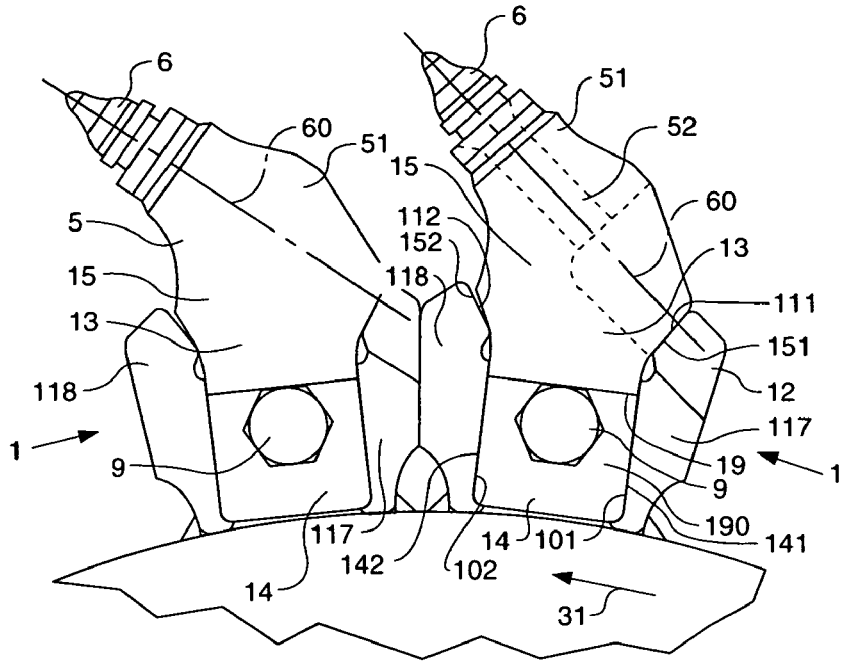
FIG. 2 is a detail of the milling drum of a scarifier to which two support bases of FIG. 1 are applied and have toolholders inserted.
Figure 3:
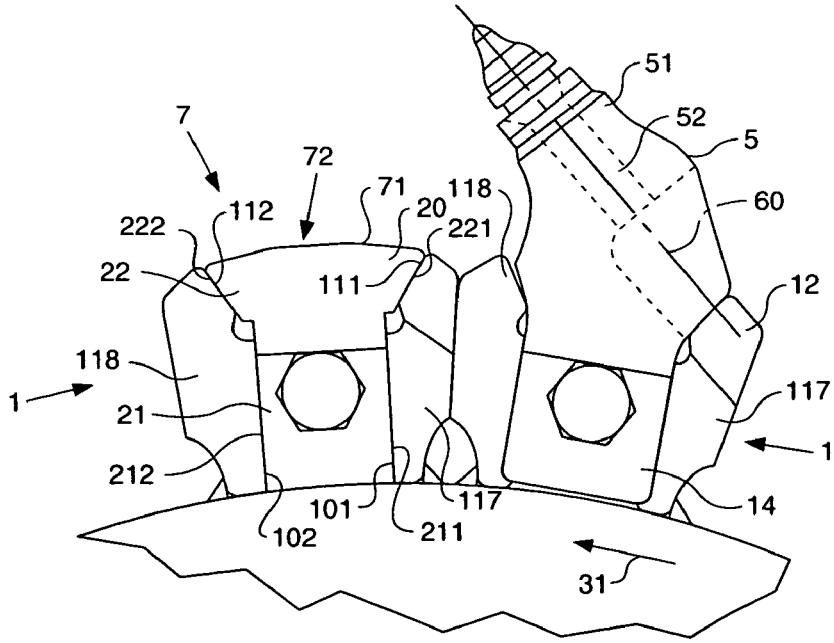
FIG. 3 is similar view to FIG. 2 in which a protection cover is inserted into one of the support bases.

Preferably the support base 1 is an integral piece of metal and is fixedly mounted onto the surface 2 by welding. As can be seen in FIG. 1, the support base 1 has wall portions forming a recess 4 in which, as shown in FIG. 3, a body, i.e. either a toolholder 5 holding a tool 6 or a protection cover 7, can be accommodated and fixedly mounted to the support base 1. In case of the toolholder 5, it is seen in FIGS. 2 and 3 that it is mounted with a tip of the tool 6 pointing in the direction of rotation 31 of the milling drum. As can be seen in FIG. 3, the protection cover 7 is different from the toolholder 5 and structured not to hold a tool.

The recess 4 of the support base 1 receives shank portions 14 and 21 of the toolholder 5 and the protection cover 7, respectively. The recess 4 is formed by a first side surface 101 on the inner side of a first side wall 117 and facing in the direction of rotation of the milling drum, a second side surface 102 provided by a second side wall 118 and opposite to the first side surface 101, and a third side surface 104 which is provided by a rear wall 103 and extends in the direction of rotation of the milling drum. The first, second, and third side surfaces 101,102, and 104 form a generally C-shaped first seat 10 of the support base opening in an axial direction of the milling drum whereby opposite to the rear wall 103 the recess 4 is open for insertion of the shank portions 14 and 21. As can be seen in the top plan view of FIGS. 5 and 9, the first and second side surfaces 101 and 102 converge towards the third side surface 104. As will be described in more detail below, the first and second side surfaces 101 and 102 therefore act as centering planes helping to lock the shank portions 14 and 21 against the rear wall 103 or the third side surface 104 in the first seat 10.

Again with reference to FIG. 1, the support base 1 further comprises a second seat 11 having generally the shape of a dovetail. The second seat 11 is formed by a reaction surface 111 and a support surface 112 converging to the underlying first seat 10 and adjoining one of the corresponding first and second side surfaces 101, 102 of the recess 4. The reaction surface 111 adjacent to the first side surface 101 is inclined thereto and is provided to further support said body, e.g. the toolholder 5 or the protection cover 7, against loads directed generally perpendicular to the reaction surface 111 as will be described in more detail below. The first side surface 101 is oriented generally perpendicular to the direction of rotation 31 whereas the reaction surface 111 is oriented under an obtuse angle with respect to the direction of rotation 31. In other words, the reaction surface 111 and the first side surface 101 include an angle of more than 180°, as indicated by reference numeral 32 in FIG. 2.

The support surface 112 is located opposite to the reaction surface 111 and adjacent the second side surface 102 of the recess 4. As the reaction surface 111, the support surface 112 is inclined to the second side surface 102 and forms with the second side surface 102 an angle of more than 180°. Preferably, the reaction surface 111 and the support surface 112 are inclinded by the same amount with respect to the first and second side surfaces 101 and 102. Further, peferably they converge only in the vertical downward direction, i.e. towards the first seat 10, whereas in the horizontal direction they extend parallel to each other.

Between the first side surface 101 and the reaction surface 111 as well as between the second side surface 102 and the support surface 112, the support base 1 comprises respective grooves 113 and 114 mainly to avoid any protrusions in that area to ensure positive contact between the first and second side surfaces 101, 102, the reaction surface 111 and the support surface 112 and respective surfaces of the body 5 or 7 to be held by the support base 1 (see FIG. 3).

With further reference to FIG. 1, the support base 1 comprises at least a through opening formed in the rear wall 103. In particular, the through opening is formed as a U-shaped slot 8 in which a fastening means 9 is to be inserted for fixing either the toolholder 5 or the cover 7 to the support base 1 (see FIGS. 6 and 10). The slot 8 has generally vertical parallel side surfaces 81, a curved bottom surface 82 and an open end 83 facing towards the second seat 11. The slot 8 or its open end 83 is sized to slidingly receive at least a portion of the fastening means 9. A center plane 50 of the slot 8 defines a symmetry plane of the centering planes defined by the first and second side surfaces 101 and 102 of the first seat 10.

Figure 6:
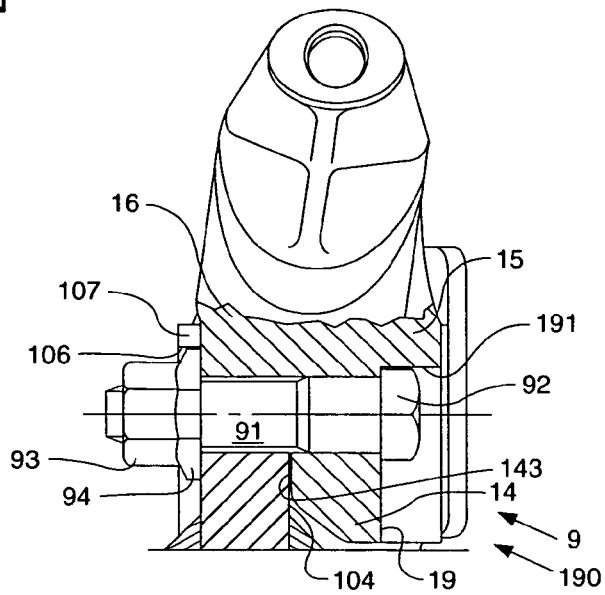
FIG. 6 is a partial sectional view along plane VI—VI in FIG. 4.
Figure 7:
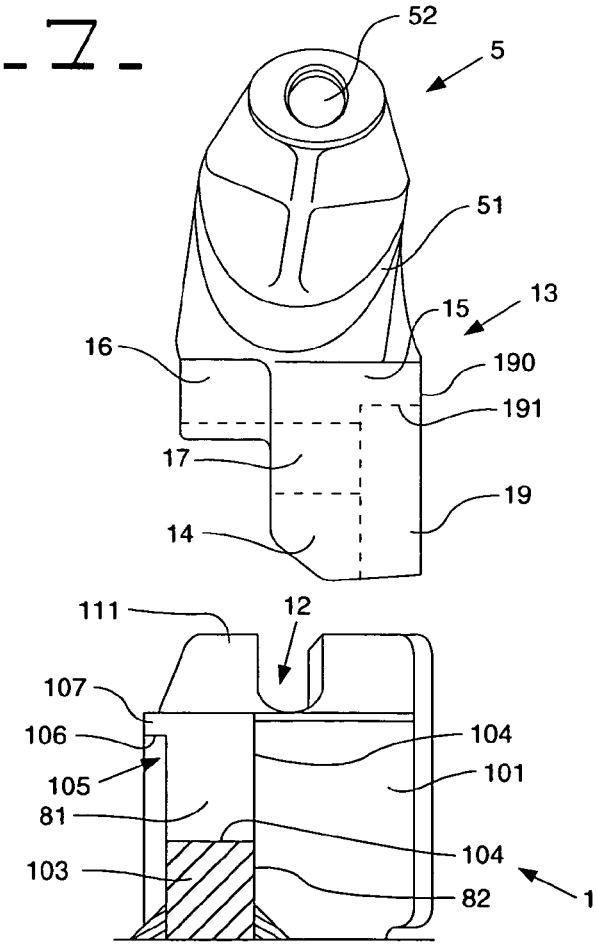
FIG. 7 shows the base and the toolholder of FIG. 6 separated from each other.
Figure 8:
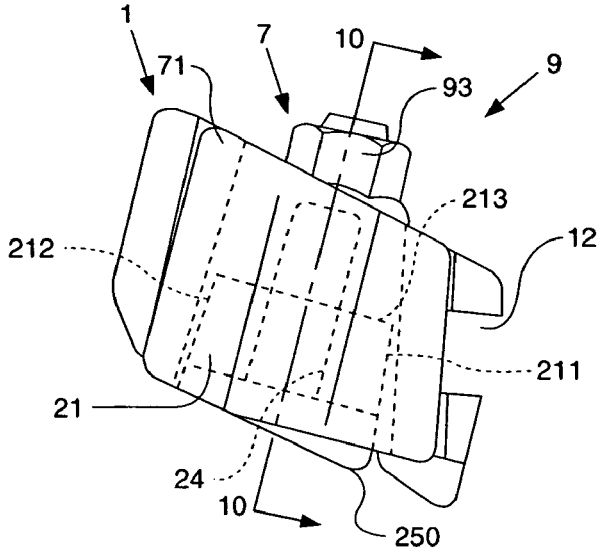
FIG. 8 is a top view of the support base having a protection cover inserted.
Figure 9:
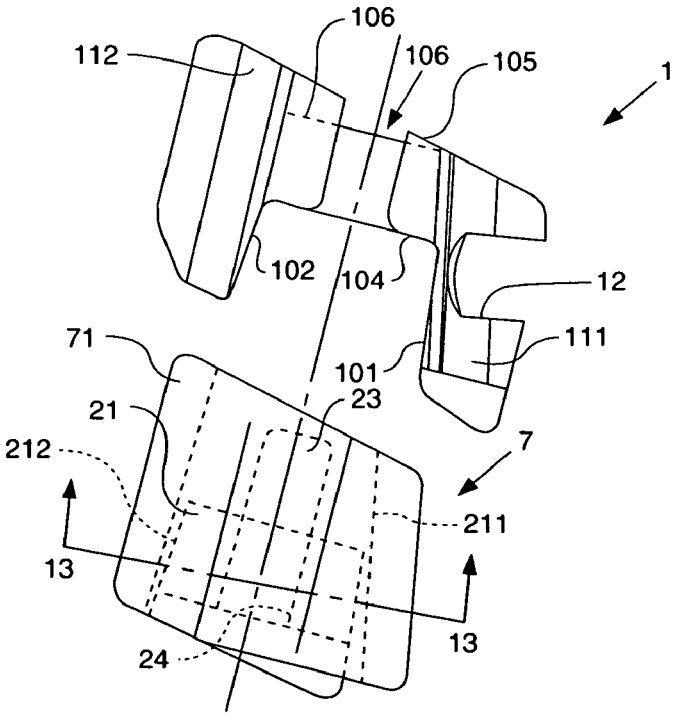
FIG. 9 is a top view of the support base and the protection cover of FIG. 8 separated from each other.
Figure 10:
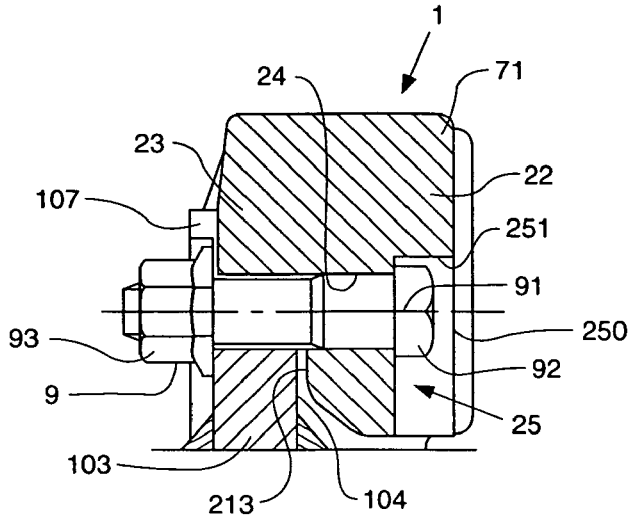
FIG. 10 is a sectional view of the support base and the inserted protection cover along plane X—X in FIG. 8.
Figure 11:
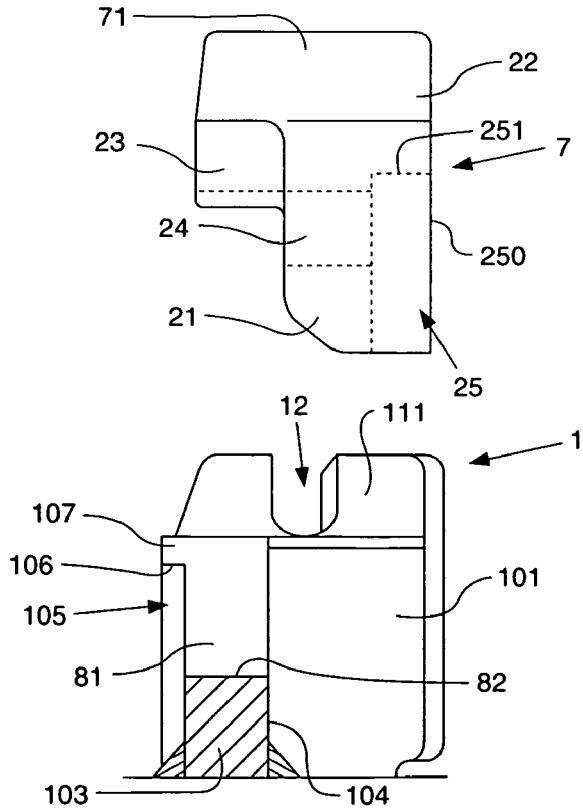
FIG. 11 shows the support base and the protection cover of FIG. 10 separated from each other.

As mentioned above, the rear wall 103 forms the third side surface 104 which is generally plane and has the same vertical orientation as the first and second side surfaces 101 and 102, e.g. generally perpendicular to a plane tangent to the surface 2 of the milling drum 3. An outer surface 105 of the rear wall 103 has an undercut 106 formed therein which at least covers the area around the slot 8. In its simplest form, as a width 84 of the slot 8 is lower than the width of the rear wall 103 in which the slot 8 is formed, the undercut 106 is provided for the full width of the rear wall 103 as shown in FIG. 9. As best seen in FIGS. 7 and 11, by providing the undercut 106 on the outer surface 105, a projection 107 is formed at the upper end of the rear wall 103 adjacent to the open end 83 of the slot. As indicated in FIGS. 6 and 10, the undercut 106 is sized to rotatably receive a portion of the fastening means 9 and the projection 107 prevents separation of the fastening means 9 from the slot 8, as will be described in more detail below.

As generally shown in FIG. 1, the support base 1 further comprises first and second outer surfaces 115, 116 of the side walls 117, 118 on which respectively the first and second side surfaces 101, 102 of the recess 4, the reaction surface 111 and the support surface 112 are provided. The outer surfaces 115, 116 are adapted so as one support base 1 can be arranged with its first outer surface 115 abuting to the second outer surface 116 of another equaly formed support base 1. The first and second outer surfaces 115, 116 are inclined so that a number of adjoined support bases 1 form a spiral along the surface 2 of the milling drum 3. To this end, preferably, the support bases 1 have a generally parallelepipedal shaped outer contour as seen for example in the top plan view of FIG. 5.

The support base 1 further comprises a lateral hole or recess 12 formed in the first side wall 117 and cutting out a portion of the reaction surface 111 of the second seat 11. The lateral hole 12 is oriented so as to define an inclined longitudinal axis 40 which coincides with a tool axis 60 of the toolholder 5 and the relevant tool 6 (see FIGS. 2 and 3).

Now referring to the toolholder 5, as generally shown in FIG. 2, it comprises a support portion 13 formed so as to be received by the first and second seats 10 and 11 of the support base 1. The toolholder 5 further has a body portion 51 provided with a through hole 52 adapted to receive the tool 6. The body portion 51, and in particular the tool axis 60 of the through hole 52, is oriented under an inclined angle with respect to the support portion 13. The orientation of the tool axis 60 of the through hole 52 and thus of the inserted tool 6 defines the direction of the forces encountered by the toolholder 5 fixed to the support base 1 when the milling drum 3 is operated to remove, for example, a road surface.

As mentioned above, the lateral hole 12 provided in the support base 1 and shown in FIGS. 2 and 3, is arranged so as to correspond with the through hole 52 made in the body portion 51 of the toolholder 5. The lateral hole 12 is aligned with the through hole 52 and is intended for the insertion of a striking pin which allows removal and replacement of the tool 6 from the toolholder 5 with the toolholder 5 fixed to the support base 1.

With reference to FIGS. 2 to 7, the support portion 13 comprises a shank portion 14 having generally a prismatic shape adapted to be coupled in the first seat 10 and a second portion 15 having a dovetail shape adapted to be coupled in the second seat 11. As particularly seen in FIGS. 4 to 7, the support portion 13 also comprises a tongue portion 16 connected to the shank portion 14 and projecting therefrom. The tongue portion 16 is adapted to be slidingly received in an upper part of the slot 8 to provide more stability for the toolholder 5 when fixed to the support base 1 and also to cover the open end 83 of the slot 8.

The shank portion 14 comprises first, second and third side surfaces 141, 142, and 143 which are adpted to cooperate with the first to third side surfaces 101, 102, and 104 of the first seat 10. The tongue portion 16 extends away from the third side surface 141. The second portion 15 comprises first and second support surfaces 151 and 152 which are adapted to cooperate with the reaction surface 111 and the support surface 112 of the second seat 11, respectively.

Figure 12:
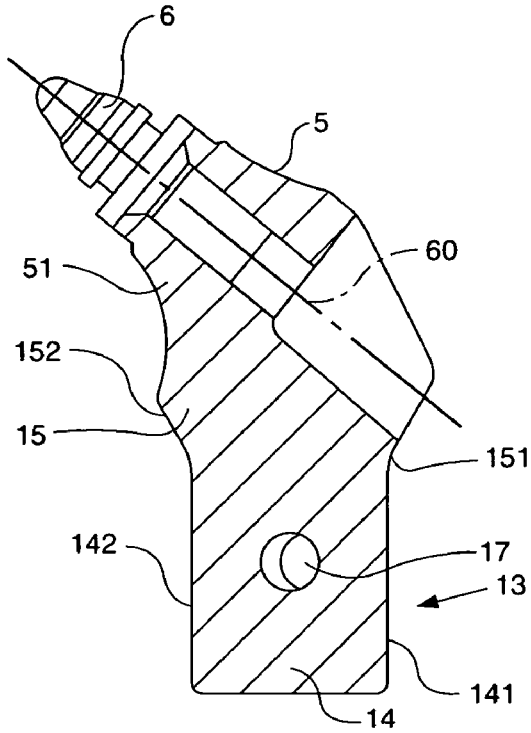
FIG. 12 is a longitudinal sectional view of the toolholder of FIG. 5 along the plane XII—XII.

With reference to FIG. 12 showing a cross section of the toolholder 5, a forward side of the toolholder 5 is defined by the orientation of the tip of the tool 6 which is oriented in the direction of rotation 31 of the milling drum 3, whereas the back of the toolholder 5 is the side facing away from the tip of the tool 6. As shown in FIGS. 2 and 3, the first support surface 151 is located on the back side of the toolholder 5 and bears firmly against the reaction surface 111 of the support base 1. The second portion 15 of the support portion 13 and thus the first support surface 151 are intersected by the through hole 52 which is aligned with the lateral hole 12 when the toolholder 5 is inserted into the support base 1.

Preferably, as seen in FIGS. 2 and 3, there is provided a small wedge shaped gap between the forward or second support surface 152 on the toolholder 5 and the support surface 112 on the support base 1 when the toolholder 5 is fixed to the support base 1. Therefore, the second support surface 152 is preferably slightly steeper inclined in comparison to the first support surface 151. This clearance is intended to ensure that the first support surface 151 of the toolholder 5 positively contacts the reaction surface 111 of the support base 1 so as to effectively transmit forces applied through the toolholder onto the support base 1, as will be described below.

Figure 4:
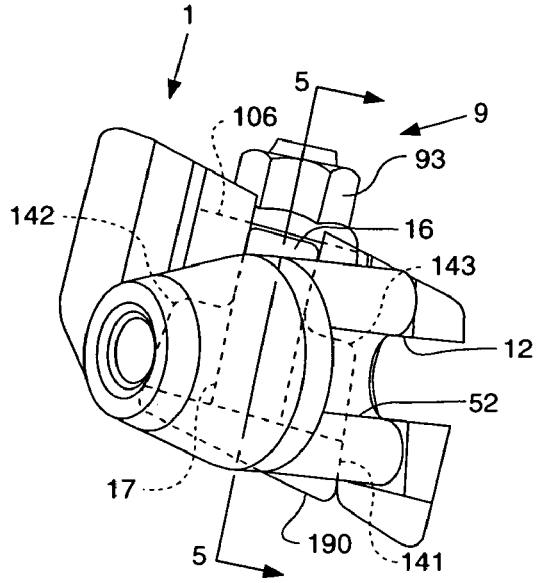
FIG. 4 is a top view of the support base having a toolholder inserted.

In FIG. 12, there is further shown a through hole 17 which is provided through the shank portion 14. The through hole 17 also intersects the tongue portion 16 of the toolholder support portion 13 (see FIGS. 6 and 7) which is located above the through hole 17. The through hole 17 receives the above mentioned fastening means 9 as best can be seen in FIGS. 4 and 6.

The shank portion 14 of the toolholder 5 has an outer surface 190 opposite to the third side surface 143 both of which are intersected by the through hole 17. The third side surface 143 abuts against the third side surface 104 of the recess 4 when the toolholder 5 is inserted into the support base 1. On the other hand, the outer surface 190 is exposed and comprises an undercut 19 which is formed to receive non-rotatably a portion of the fastening means 9. The undercut 19 provides a datum plane 191 which prevents unthreading of the fastening means 9, as will be described below.

The fastening means 9 in turn, as shown with particular reference to FIG. 6, comprise a screw 91 which passes through the hole 17 and the slot 8. The screw 91 is provided at one end with a driving head 92 and threadingly receives at the opposite end a tightening nut 93. The driving head 92 has a general hexagonal cross sectional shape and one of its surfaces comes into contact with the datum plane 191 defined by the undercut 19 when the screw 91 is inserted into the through hole 17. The datum plane 191 prevents the rotation of the head 92 and thus of the screw 91 when the head 92 is received in the undercut 19. Preferably the undercut 19 is sized to completely receive the head 92.

Further, as shown in FIGS. 6 and 7, the nut 93 is accommodated in the above described undercut 106 formed in the outer surface 105 of the rear wall 103. As mentioned, the undercut 106 and in particular the projection 107 function to prevent unthreading or loosening of the nut 93 from the screw 91 and thus loosening of the toolholder 5. Preferably, the nut 93 has a plane base 94 which ensures a better rest and also interference with a machined surface of the undercut 106. Thus, the nut 93 can be tightened onto the screw 91 until the plane base 94 firmly bears against the outer surface 105.

The protection cover 7 is also adapted to be fixed to the support base 1 in a similar manner to the toolholder 5. As shown in FIG. 3, it comprises a flat body portion 71 having an outer surface 72 with an outwardly convex profile and it is adapted to close or cover the first and second seats 10 and 11 of the support base 1. The protection cover 7 comprises a support portion 20 (see FIG. 11) adapted to be coupled to the first and second seats 10 and 11 of the support base 1 in a similar manner to the toolholder 5.

With reference to FIGS. 8 to 11, the support portion 20 of the protection cover 7 comprises a shank portion 21 of a generally prismatic shape adapted to be coupled in the first seat 10. A second portion 22 of the support portion 20 has a dovetail shape and is adapted to be coupled in the second seat 11. As seen in FIGS. 8 to 11, the support portion 20 further comprises a tongue portion 23 having a generally parallelepipedal shape which is adapted to be slidingly received in the slot 8.

Figure 13:
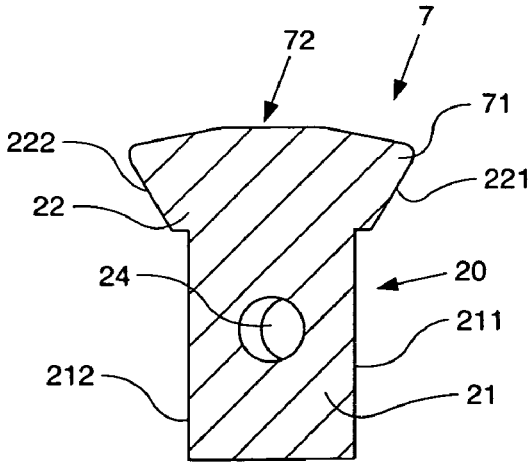
FIG. 13 is a longitudinal sectional view of the protection cover of FIG. 9 along plane XIII—XIII.

The shank portion 21 is formed by first to third side surfaces 211 to 213 adapted to cooperate with the first to third side surfaces 101, 102 and 104 of the first seat 10. The second portion 22 comprises first and second support surfaces 221 and 222 adapted to cooperate with the reaction surface 111 and the support surface 112 of the second seat 11, respectively (see FIG. 13). As shown in FIG. 3, the first and second support surfaces 221 and 222 firmly contact the reaction surface 111 and the support surface 112 of the second seat 11 so as to close the first and second seats 10 and 11 when the protection cover 7 is inserted into the support base 1.

A through hole 24 is provided in the shank portion 21 and the tongue portion 23 of the support portion 20 with the tongue portion 23 located at an upper side of the through hole 24. As the through hole 17 of the toolholder 5, the through hole 24 is adapted to receive the fastening means 9 consisting, as described above, of the screw 91 with the driving head 92 and the tightening nut 93 (see FIG. 10).

As shown in more detail in FIGS. 10 and 11, also the protection cover 7 has an undercut 25 with a datum plane 251 provided on an outer surface 250 of the shank portion 21. The datum plane 251 cooperates with one of the surfaces defining the driving head 92 of the screw 91 to prevent its unscrewing, as described above for toolholder 5. The inner or third side surface 213 of the shank portion 21 comes into contact with the inner or third side surface 104 of the rear wall 103. As the tongue portion 16 of the toolholder 5, the tongue portion 23 of the protection cover is received in an upper part of the U-shaped slot 8 and closes the same. With the protection cover 7 inserted, the support base 1 is closed in a compact fashion and protected against dirt.

INDUSTRIAL APPLICABILITY

In order to fix the toolholder 5 to the support base 1, it is sufficient to slidingly insert the support portion 13 into the recess 4, paying attention that the tongue portion 16 of the support portion 13 is inserted into the slot 8. The C-shaped profile of the first seat 10 and the dovetail profile of the second seat 11 facilitate an easy and quick insertion of the toolholder 5 into the support base 1. In particular, the converging first and second side surfaces 101 and 102 of the support base 1 in cooperation with the first and second side surfaces 141 and 142 allow centering and firm locking of the shank portion 14 in the first seat 10 against the wall 103. The second seat 11 in cooperation with the first and second support surfaces 151 and 152 on the second portion 15 of the toolholder acts as sliding guidance or rail when inserting the toolholder 5 into the support base 1.

After coupling into the support base 1, the toolholder 5 is fixed or blocked from removing by inserting the screw 91 through the shank portion 14 and the slot 8. The screw 91 is then tightened by the nut 93 until its base 94 bears against the outer surface 105 of the wall 103.

The wedge shaped gap between the second support surface 152 and the support surface 112 of the second seat 11 on the forward side of the toolholder 5 warrants absence of play between the first support surface 151 and the reaction surface 111 of the support base 1 when the screw 9 blocks the toolholder 5 in the recess 4.

After having inserted the desired number of toolholders 5 in corresponding support bases 1, the milling drum 3 is ready to be used. As indicated in FIG. 2, the milling drum 3 has the toolholders 5 with the relevant tools 6 arranged along a spiral around the milling drum 3 with their tips facing in the direction of rotation 31.

In operation, the tools 6 apply forces on the toolholders 5 generally along the tool axis 60. A major part of those forces is advantageously taken up by the reaction surface 111 of the support base 1 which directs the forces through the wall 117 towards the milling drum 3. Thus, less shear forces are transmitted through the shank portion 14 of the toolholder to the first side surface 101 of the recess 4. This increases the stability of the support bases 1 and allows building them with a lower height. In particular, the body portions 51 of the toolholders 5 may project from the support bases 1 by a considerable amount without compromising the stability of the toolholder support portions 13 kept in the support bases 1. Thus, the tips of the tools 6 can be arranged further away form the support bases 1 on the milling drum 3.

In particular, when the milling drum 3 is provided with parallel spirals of the support bases 1, the toolholders 5 applied to the support base spirals can be arranged more densely so as to adapt the milling drum 3 for grinding operations. On the other hand, if it is desired to adapt the milling drum 3 to a different work condition by removing the toolholders 5 from selected ones of the spirals, the support bases 1 of the respective emptied spirals can be covered with the covers 7, as shown in FIG. 3. Advantageously, the toolholders 5 and the protection covers 7 are provided with support portions 13 and 20, respectively, of the same shape so as to interchangably be coupled to the same support base 1. Thus, for example, to double the pitch between the tools 6, it is sufficient to remove all the toolholders 5 from one of the support base spirals and replace them by as many protection covers 7 which are then coupled into the corresponding recess 4 just in the same manner as described for the toolholders 5. The support bases 1 without toolholders 5 are then protected against contact with the soil by applying the protection covers 7. Thus, it is possible to double the pitch of the spirals along which the active elements of the milling drum 3 are arranged and at the same time to protect also the support bases 1 from soil contact.

Especially when the drum is operated for a rather long period of time the toolholders 5 may frequently get strongly stuck to the corresponding support base. However, with the design of the support bases 1, the toolholders 5 can be more readily loosened from the support bases 1 because the support bases 1 with a lower height have a lower surface area onto which the surfaces of the shank portions 14 of the toolholders 5 may get stuck.

As the support bases 1 can be constructed with a quite low height and also the covers 7 do not project by a significant amount from the support bases 1, the support bases 1 not equipped with toolholders 5 do not interfere with the toolholders 5 remaining on the milling drum. In other words, the tools 6 held by the toolholders 5 can dig deeper into the ground or road surface.

Therefore, the free support bases 1 are not prone to be damaged seriously in consequence of contacting the soil to be removed.

Also, the provision of the slot 8 for receiving the fastening means 9 helps in lowering the height of the support bases 1. In fact, the slot 8 has only to be provided with a minimum depth so as to receive the screw 91. The height of the rear wall 103 including the slot 8 is mainly determined by the size of the nut 93, as can be seen for example in FIGS. 6 and 10.

It also has to be noted that for disassembly or removal and also for subsequent mounting of the toolholders 5 or the protection covers 7 from and onto the support bases 1, the screws 91 never have to be completely unthreaded and taken out from the shank portions 14 and 21 of the toolholders 5 and protection covers 7, respectively. Advantageously, it is sufficient to loosen the nut 93 by an amount sufficient to take it out from the undercut 106 of the support base 1 in order to remove the screw 91 from the slot 8. The fastening means 9 is then kept with the toolholder 5 or the protection cover 7 and does not get lost so easily.

While a specific embodiment of the invention has been described and shown in detail, it should be appreciated that to those skilled in the art various modifications and alternatives of details may occur in the light of the overall teachings of the disclosure. For example, the fastening means 9 consisting of a screw 91 and a nut 93 may be modified by permanently attaching a stud to the shank portion 14 or 21, the stud being provided with a threaded surface to receive a corresponding nut. Thus, it is intended to take the above description as illustrative only and not limiting as to the scope of the invention which is defined by the appended claims and all equivalents thereof.

The invention claimed is:

1. A support base (1) adapted to be mounted to the surface (2) of a milling drum (3) defining a direction of rotation (31), said support base (1) including a recess (4) adapted to receive removably a shank portion (14; 21) of a body (5; 7) to be fixedly mounted to said support base (1), said recess (4) being at least partly formed by a wall (103) including a slot (8) open at one end (83), said open end (83) being adapted for insertion of a fastening means (9) into said slot (8) for fixing said body (5; 7) to said support base (1), wherein said recess (4) includes a generally C-shaped first seat (10) formed by a first side surface (101), and a second side surface (102) opposite thereto, said first and second side surfaces converging to a third side surface (104) between said first and second side surfaces (101,102);

wherein said support base (1) further includes a support surface (112) adjacent said second side surface (102) of said recess (4) and inclined thereto, a reaction surface (111) and said support surface (112) forming a generally dovetail shaped second seat (11) above and adjacent said first seat (10), and wherein said wall (103) in which said slot (8) is formed has an outer surface (105) opposite to said third surface (104), said outer surface (105) includes an undercut (106) adapted to receive at least a portion of said fastening means (9).

2. Support base (1) of claim 1, wherein said undercut (106) is adapted to rotatably receive a portion of said fastening means (9), said undercut (106) further has a machined surface adjacent said slot (8) and being provided for firmly bearing against a base surface (94) of said fastening means (9).

3. Support base (1) of claim 1, further including a lateral hole (12) intersecting said reaction surface (111), said lateral hole (12) having a longitudinal axis (50) oriented to coincide with a predefined axis (60) of said body (5) supported by said support base (1).

4. Support base (1) of claim 1, wherein grooves (113,114) are provided between said first side surface (101) and said reaction surface (111) and between said second side surface (102) and said support surface (112), respectively.

5. The support base (1) of claim 1, wherein said first side surface (101) is adapted to contact said shank portion (14; 21) of said body (5; 7);

said support base (1) further including said reaction surface (111) adjacent to said first side surface (101) and also facing in said direction of rotation (31), said reaction surface (111) being adapted to bear against a support surface (151) of said body (5; 7).

6. The support base (1) of claim 5, wherein said reaction surface (111) and said first side surface (101) form an angle of greater than 180°.

7. The support base (1) of claim 5, further including a lateral hole (12) intersecting said reaction surface (111), said lateral hole (12) having a longitudinal axis (50) oriented to coincide with a predefined axis (60) of said body (5) supported by said support base (1).

8. The support base (1) of claim 5, wherein grooves (113,114) are provided between said first side surface (101) and said reaction surface (111) and between said second side surface (102) and said support surface (112), respectively.

9. The support base (1) of claim 1, wherein said slot (8) is of a U-shaped profile having said open end (83) facing towards said second seat (11) and having generally vertical parallel side surfaces (81) and a concave bottom surface (82).

10. The support base (1) of claim 9, wherein said first and second side surfaces (101, 102) define centering planes which are symmetric about a center plane (50) of said slot (8).

11. A support base (1) mounted to the surface (2) of a milling drum (3) defining a direction of rotation (31), said support base (1) including a recess (4) adapted to receive removably a shank portion (14; 21) of a body (5; 7) to be fixedly mounted to said support base (1), said recess (4) being at least partly formed by a wall (103) including a slot (8) open at one end (83), said open end (83) being adapted for insertion of a fastening means (9) into said slot (8) for fixing said body (5; 7) to said support base (1), wherein said recess (4) includes a generally C-shaped first seat (10) formed by a first side surface (101) facing in the direction of rotation of the milling drum (3) to which the support base (1) is mounted, and a second side surface (102) opposite thereto, said first and second side surfaces converging to a third side surface (104) between said first and second side surfaces (101,102);

wherein said support base (1) further includes a support surface (112) adjacent said second side surface (102) of said recess (4) and inclined thereto, a reaction surface (111) and said support surface (112) forming a generally dovetail shaped second seat (11) above and adjacent said first seat (10).

12. The support base (1) mounted to the surface (2) of a milling drum (3) of claim 11, wherein said first side surface (101) is adapted to contact said shank portion (14; 21) of said body (5; 7);

said support base (1) further including said reaction surface (111) adjacent to said first side surface (101) and also facing in said direction of rotation (31), said reaction surface (111) being adapted to bear against a support surface (151) of said body (5; 7).

13. The support base (1) mounted to the surface (2) of a milling drum (3) of claim 12, wherein said reaction surface (111) and said first side surface (101) form an angle of greater than 180°.

14. The support base (1) mounted to the surface (2) of a milling drum (3) of claim 12, further including a lateral hole (12) intersecting said reaction surface (111), said lateral hole (12) having a longitudinal axis (50) oriented to coincide with a predefined axis (60) of said body (5) supported by said support base (1).

15. The support base (1) mounted to the surface (2) of a milling drum (3) of claim 12, wherein grooves (113,114) are provided between said first side surface (101) and said reaction surface (111) and between said second side surface (102) and said support surface (112), respectively.

16. The support base (1) mounted to the surface (2) of a milling drum (3) of claim 11, wherein said slot (8) is of a U-shaped profile having said open end (83) facing towards said second seat (11) and having generally vertical parallel side surfaces (81) and a concave bottom surface (82).

17. The support base (1) mounted to the surface (2) of a milling drum (3) of claim 16, wherein said first and second side surfaces (101, 102) define centering planes which are symmetric about a center plane (50) of said slot (8).

18. A support base (1) adapted to be mounted to the surface (2) of a milling drum (3) defining a direction of rotation (31), said support base (1) including a recess (4) adapted to receive removably a shank portion (14; 21) of a body (5; 7) to be fixedly mounted to said support base (1), said recess (4) being at least partly formed by a wall (103) including a slot (8) open at one end (83), said open end (83) being adapted for insertion of a fastening means (9) into said slot (8) for fixing said body (5; 7) to said support base (1), wherein said recess (4) includes a generally C-shaped first seat (10) formed by a first side surfaces (101), a second side surface (102) opposite thereto, said first and second side surfaces converging to a third side surface (104) between said first and second side surfaces (101, 102), the third side surface (104) extending in the direction of rotation of the milling drum (3);

wherein said support base (1) further includes a support surface (112) adjacent said second side surface (102) of said recess (4) and inclined thereto, a reaction surface (111) and said support surface (112) forming a generally dovetail shaped second seat (11) above and adjacent said first seat (10);

wherein said first side surface (101) is adapted to contact said shank portion (14; 21) of said body (5; 7);

said support base (1) further including said reaction surface (111) adjacent to said first side surface (101) and also facing in said direction of rotation (31), said reaction surface (111) being adapted to bear against a support surface (151) of said body (5; 7); and further including a lateral hole (12) intersecting said reaction surface (111), said lateral hole (12) having a longitudinal axis (50) oriented to coincide with a predefined axis (60) of said body (5) supported by said support base (1).

19. A support base (1) adapted to be mounted to the surface (2) of a milling drum (3) defining a direction of rotation (31), said support base (1) including a recess (4) adapted to receive removably a shank portion (14; 21) of a body (5; 7) to be fixedly mounted to said support base (1), said recess (4) being at least partly formed by a wall (103) including a slot (8) open at one end (83), said open end (83) being adapted for insertion of a fastening means (9) into said slot (8) for fixing said body (5; 7) to said support base (1), wherein said recess (4) includes a generally C-shaped first seat (10) formed by a first side surface (101), a second side surface (102) opposite thereto, said first and second side surfaces converging to a third side surface (104) between said first and second side surface (101, 102), the third side surface (104) extending in the direction of rotation of the milling drum (3);

wherein said support base (1) further includes a support surface (112) adjacent said second side surface (102) of said recess (4) and inclined thereto, a reaction surface (111) and said support surface (112) forming a generally dovetail shaped second seat (11) above and adjacent said first seat (10);

wherein said first side surface (101) is adapted to contact said shank portion (14; 21) of said body (5; 7);

said support base (1) further including said reaction surface (111) adjacent to said first side surface (101) and also facing in said direction of rotation (31), said reaction surface (111) being adapted to bear against a support surface (151) of said body (5; 7); and wherein grooves (113,114) are provided between said first side surface (101) and said reaction surface (111) and between said second side surface (102) and said support surface (112), respectively.

* * * * *

UNITED STATES PATENT AND TRADEMARK OFFICE

CERTIFICATE OF CORRECTION

PATENT NO. : 7,192,095 B2
APPLICATION NO. : 10/476895
DATED : March 20, 2007
INVENTOR(S) : Sansone et al.

Figure 5:
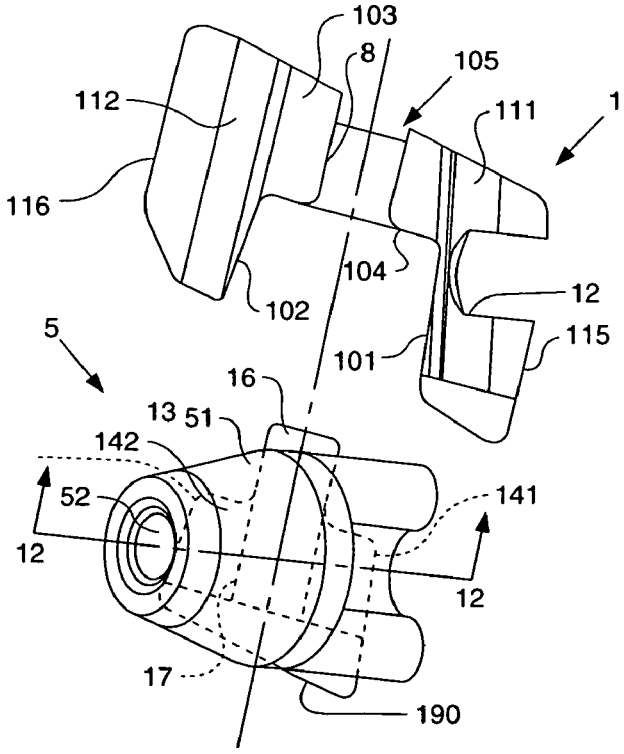
FIG. 5 shows the support base and relevant toolholder of FIG. 4 separated from each other.

It is certified that error appears in the above-identified patent and that said Letters Patent is hereby corrected as shown below:

In Fig. 5, Sheet 3 of 7, delete “ 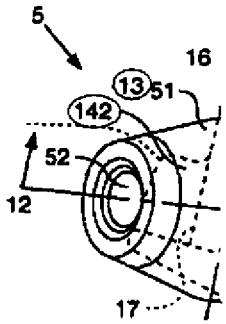

” and insert

-- 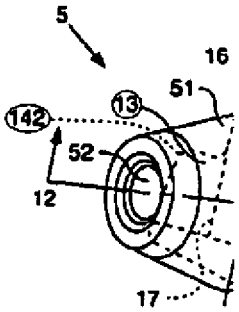

--, therefor.

In Column 1, Lines 21-22, delete “accomodates” and insert -- accommodates --, therefor.

In Column 4, Lines 22-23, delete “peferably” and insert -- preferably --, therefor.

In Column 5, Line 5, delete “equaly” and insert -- equally --, therefor.

In Column 5, Line 51, delete “adpted” and insert -- adapted --, therefor.

UNITED STATES PATENT AND TRADEMARK OFFICE

CERTIFICATE OF CORRECTION

PATENT NO. : 7,192,095 B2
APPLICATION NO. : 10/476895
DATED : March 20, 2007
INVENTOR(S) : Sansone et al.

It is certified that error appears in the above-identified patent and that said Letters Patent is hereby corrected as shown below:

In Column 8, Line 33, delete “interchangably” and insert -- interchangeably --, therefor.

Signed and Sealed this

Seventh Day of July, 2009

JOHN DOLL
*Acting Director of the United States Patent and Trademark Office*